US008062433B2

(12) United States Patent
Yoo

(10) Patent No.: US 8,062,433 B2
(45) Date of Patent: Nov. 22, 2011

(54) PANEL SPACER OF DISH WASHER, AND DISH WASHER USING THE SAME

(75) Inventor: Byung Kook Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 650 days.

(21) Appl. No.: 10/592,497

(22) PCT Filed: Jan. 25, 2006

(86) PCT No.: PCT/KR2006/000287

§ 371 (c)(1),
(2), (4) Date: Nov. 23, 2007

(87) PCT Pub. No.: WO2006/080802

PCT Pub. Date: Aug. 3, 2006

(65) Prior Publication Data

US 2008/0196750 A1 Aug. 21, 2008

(30) Foreign Application Priority Data

Jan. 25, 2005 (KR) ..... 10-2005-0006620

(51) Int. Cl.
*B08B 3/00* (2006.01)

(52) U.S. Cl. ..... 134/57 D; 134/56 D; 134/58 D

(58) Field of Classification Search ..... 134/56 D, 134/57 D, 58 D
See application file for complete search history.

(56) References Cited

U.S. PATENT DOCUMENTS

| | | | | | |
|---|---|---|---|---|---|
| 2,024,192 | A | * | 12/1935 | Verhagen | 49/489.1 |
| 4,850,144 | A | * | 7/1989 | Grisham et al. | 49/482.1 |
| 5,908,227 | A | * | 6/1999 | Wilhelmstatter et al. | 312/204 |

FOREIGN PATENT DOCUMENTS

| | | | | |
|---|---|---|---|---|
| DE | 7902525 | | | 1/1979 |
| DE | 8002935 | U1 | | 5/1980 |
| DE | 3104083 | A1 | | 8/1982 |
| EP | 2505 | A1 | * | 6/1979 |
| EP | 1462029 | A2 | | 9/2004 |
| FR | 2702803 | A3 | * | 9/1994 |
| GB | 2040162 | A | | 8/1980 |

* cited by examiner

*Primary Examiner* — Michael Barr
*Assistant Examiner* — Charles W Kling
(74) *Attorney, Agent, or Firm* — McKenna Long & Aldridge LLP

(57) ABSTRACT

A panel spacer and a dishwasher using the panel spacer are provided. The dishwasher has a door and a control panel located a predetermined distance from the door. The panel spacer includes a spacer cover installed between the door and the control panel, and at least one spacer body coupled to the spacer cover. The spacer body fills a gap between the door and the control panel together with the spacer cover.

10 Claims, 2 Drawing Sheets

[Fig. 1]
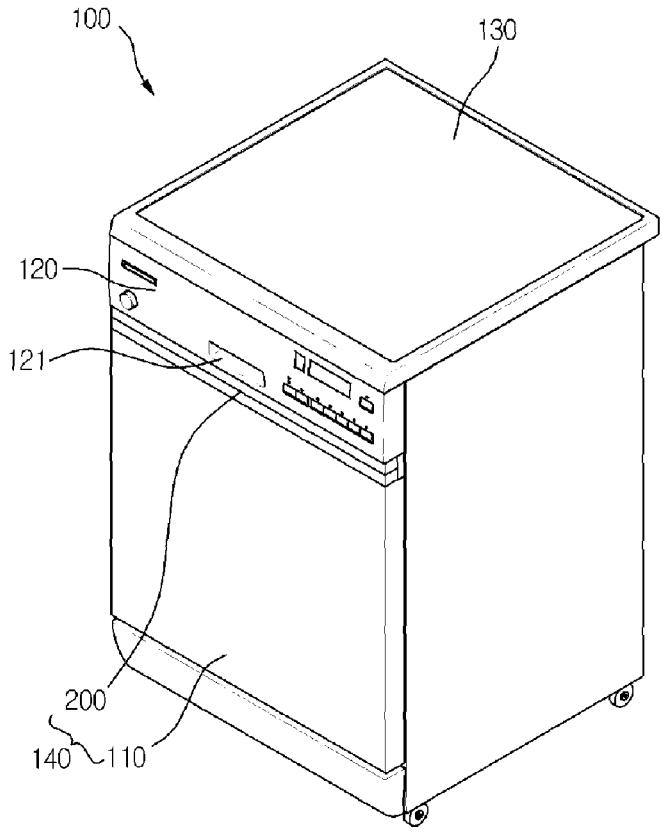
[Fig. 2]
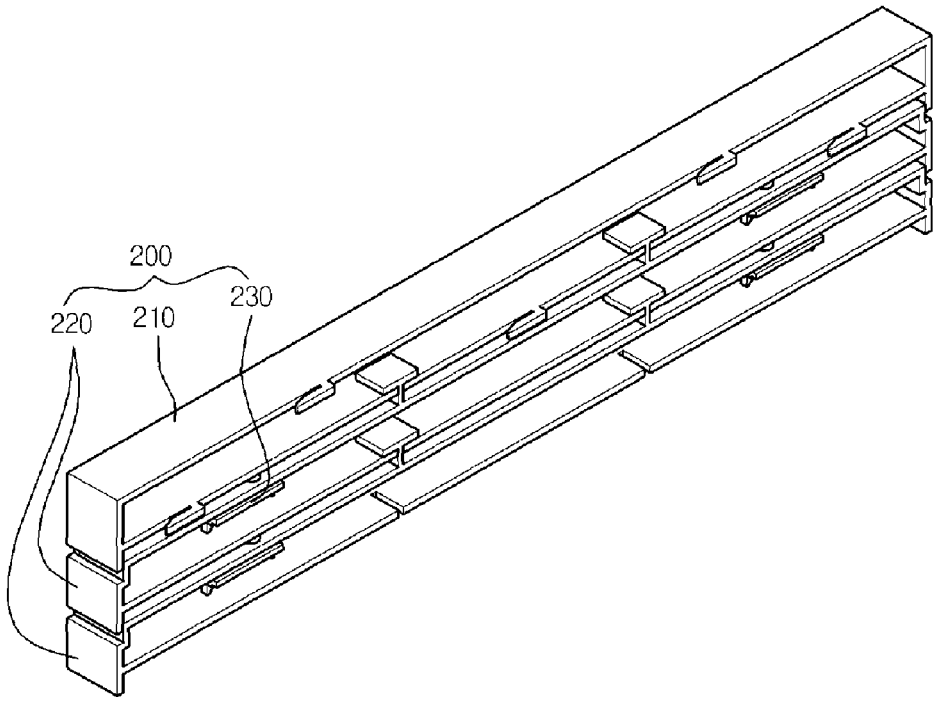

[Fig. 3]
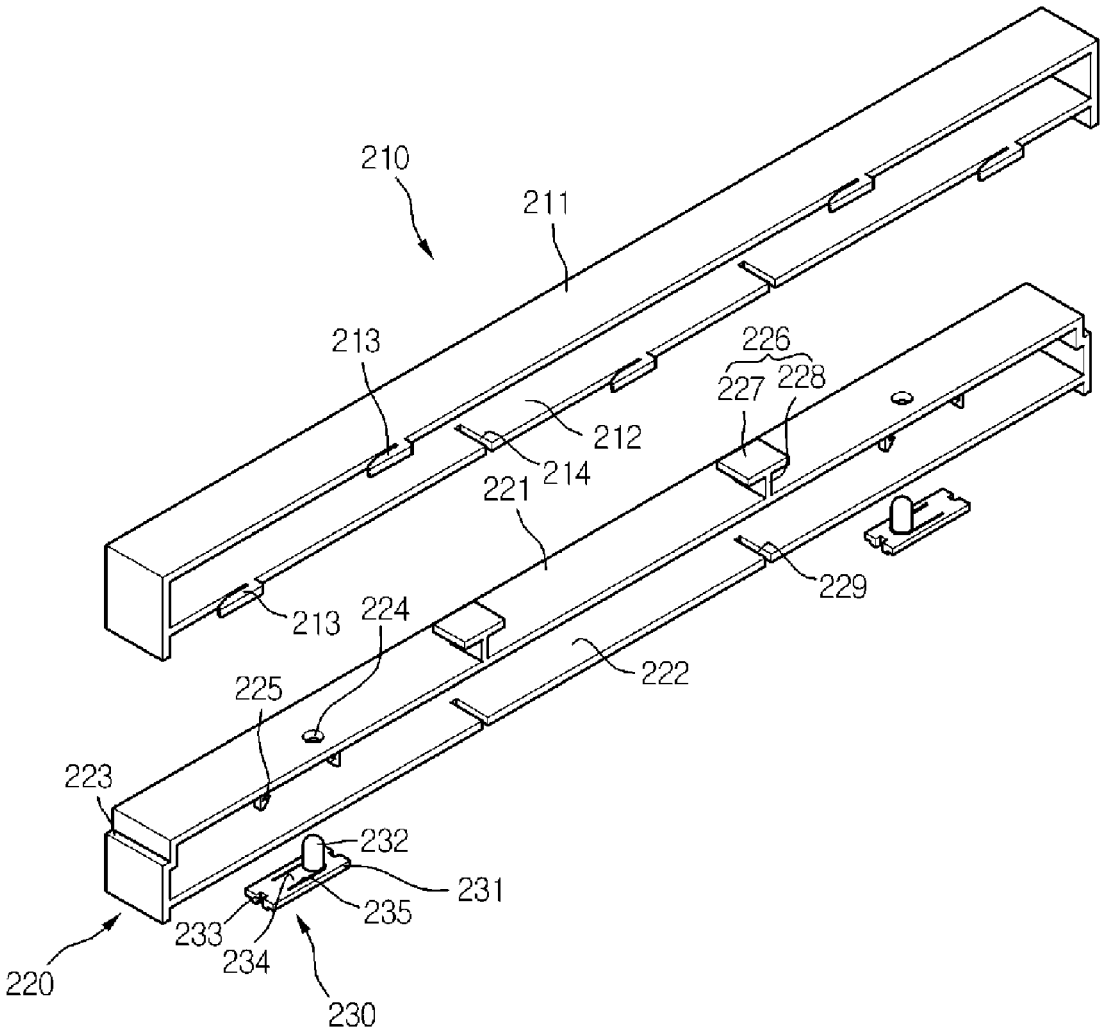
[Fig. 4]
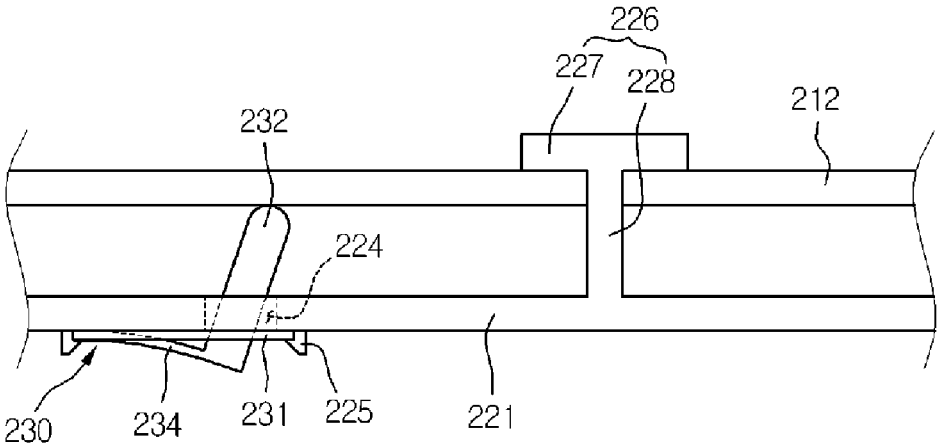

PANEL SPACER OF DISH WASHER, AND DISH WASHER USING THE SAME

This application claims the benefit of Korean Patent Application No. 2004-0006620, filed on Jan. 25, 2005 and PCT Application No. PCT/KR2006/000287, filed on Jan. 25, 2006, which is hereby incorporated by reference for all purposes as if fully set forth herein.

TECHNICAL FIELD

The present invention relates to a dishwasher, and more particularly, to a panel spacer of a dishwasher and a dishwasher using the same.

BACKGROUND ART

A dishwasher is a home appliance that sprays high-pressure wash liquid through spray nozzles to wash and remove food residue left on surfaces of dishes. Specifically, a dishwasher includes a tub forming a wash compartment, and a sump installed at the bottom of the tub for storing wash liquid. Installed inside the sump is a wash pump that pumps wash liquid to the spray nozzles. The wash liquid pumped to the spray nozzles is discharged under high pressure through spray holes at the ends of the nozzles. The high-pressure wash liquid spray collides with the surfaces of dishes, so that food residue and other impurities on the dishes fall to the floor of the tub.

A door at the front of the dishwasher has a front panel installed at its front portion for aesthetic purposes. A control panel is installed above the door. The control panel includes various buttons, a display portion, etc.

However, in dishwashers according to the related art, front panels are sized according to the type of product they are intended for. Thus, when a front panel is installed on a door, and the dimensions of the former are smaller than those of the latter, a gap is created between the top of the front panel and the control panel, creating an unsightly appearance.

DISCLOSURE OF INVENTION

Technical Problem

An object of the present invention is to provide a panel spacer of a dishwasher capable of filling a gap between a front panel of a door and a control panel to create the outward appearance of a single cover, and a dishwasher using the panel spacer.

Technical Solution

According to an aspect of the present invention, there is provided a panel spacer of a dishwasher having a door and a control panel located a predetermined distance from the door, the panel spacer including: a spacer cover installed between the door and the control panel; and at least one spacer body coupled to the spacer cover for filling a gap between the door and the control panel together with the spacer cover.

According to another aspect of the present invention, there is provided a dishwasher having a door and a control panel located a predetermined distance from the door, the dishwasher including: a spacer cover installed between the door and the control panel; at least one spacer body coupled to the spacer cover for filling a gap between the door and the control panel together with the spacer cover; and an elastic member coupled between the spacer cover and the spacer body and/or between two spacer bodies, the elastic member for pressing against the spacer cover and/or one of the two spacer bodies.

Advantageous Effects

The panel spacer and the dishwasher using the same according to the present invention allows the panel spacer to be mounted in order to give the dishwasher the outward appearance of having a single front panel, when a front panel that is installed on the front of a door has different dimensions than the door.

Additionally, even when the size of doors vary according to the type of product, the panel spacer according to the present invention can be installed, so that the same front panel can be used on different products regardless of their door size, thus reducing manufacturing cost.

BRIEF DESCRIPTION OF THE DRAWINGS

FIG. 1 is a perspective view of a dishwasher according to the present invention.

FIG. 2 is a perspective view showing an assembled panel spacer according to the present invention.

FIG. 3 is an exploded perspective view showing the panel spacer in FIG. 2 in a disassembled state.

FIG. 4 is a diagram showing a portion of a panel spacer according to the present invention in a coupled state.

BEST MODE FOR CARRYING OUT THE INVENTION

Hereinafter, preferred embodiments of a dishwasher according to the present invention will be described in detail with reference to the accompanying drawings.

FIG. 1 is a perspective view of a dishwasher according to the present invention.

Referring to FIG. 1, a dishwasher 100 according to the present invention includes an outer case 130 forming the outer shape of the dishwasher 100 and protecting the components within, and a door 140 installed at the front portion of the outer case 130 for opening and closing the front of the wash compartment.

In further detail, the door 140 has a front panel 110 mounted on the front thereof, and a panel spacer 200 installed if the dimensions of the door 140 and the front panel 110 are different. The panel spacer 200 is formed to be stackable, so that an appropriate number of panel spacer 200 pieces can be stacked and assembled according to the dimensional discrepancy between the front panel 110 and the door 140. The structure of the panel spacer 200 will be described below with reference to the diagrams.

FIG. 2 is a perspective view showing an assembled panel spacer according to the present invention, FIG. 3 is an exploded perspective view showing the panel spacer in FIG. 2 in a disassembled state; and FIG. 4 is a diagram showing a portion of a panel spacer according to the present invention in a coupled state.

Referring to FIGS. 2 through 4, the panel spacer 200 according to the present invention includes a spacer cover 210 with a predetermined width and length, a spacer body 220 stacked below the spacer cover 210, and an elastic member 230 inserted between the spacer cover 210 and the spacer body 220 and between respective spacer bodies 220 to provide elasticity to each spacer body 220.

In further detail, the spacer cover 210 provides the base for stacking the panel spacer 200, and includes an upper plate 211 and a lower plate 212 spaced a predetermined distance below and formed parallel to the upper plate 211. The upper and lower plates 211 and 212 are injection molded in one piece. A door hook 213 is formed at the rear of the upper plate 211 and the lower plate 212 for coupling the spacer cover 210 to the front of the door 140, and a connector receptacle 214 cut a predetermined distance into the rear of the lower plate 212 for coupling the spacer body 220 to the bottom of the spacer cover 210.

As a structure for stacking below the spacer cover 210, the spacer body 220 has stepped spacer cover seat 223 formed at either end thereof to seat the lower portion of the spacer cover 210 on. Like the spacer cover 210, the spacer body 220 also has an upper and lower plate 221 and 222. The upper plate 221 has at least one knob through-hole 224 formed therein for accommodating the insertion of an inserting knob 232 of the elastic member 230 (to be described below). An elastic member retaining hook 225 for fixing the elastic member 230 is formed on the bottom surface of the upper plate 221 around the knob through-hole 224. A connector 226 for fastening the spacer body 220 to the spacer cover 210 is formed to protrude a predetermined height from the top surface of the upper plate 221. Specifically, the connector 226 has a vertical portion 228 extending a predetermined height from the upper surface of the upper plate 221, and a horizontal portion 227 extending horizontally across the top of the vertical portion 228 to form a "T" shape therewith. The connector 226 inserts into the connector receptacle 214 of the spacer cover 210.

Also, a connector receptacle 229, for inserting the connector 226 of another spacer body 220 to couple the two spacer bodies 220, is formed on the lower plate 222 of a spacer body 220.

The elastic member 230 that inserts between the spacer body 220 and the spacer cover 210 and between stacked spacer bodies 220 has a roughly rectangular box-shaped body 231, a retaining hook slot 233 cut a predetermined depth into either end portion of the body 231 for inserting the elastic member retaining hook 225, a flexible arm 234 formed a predetermined length within the body 231, and an inserting knob 232 protruding a predetermined height from the end of the flexible arm 234. A cut-out 235 is formed within the body 231 around the perimeter of the flexible arm 234 to give the flexible arm 234 a predetermined amount of elasticity.

To explain the assembling process of the above-described panel spacer 200, the elastic member 230 is first inserted between the elastic member retaining hooks 225 formed at the bottom of the upper plate 221 of the spacer body 220, while the inserting knob 232 is inserted through the knob through-hole 224. The elastic member retaining hooks 225 have their bottom portions bent inward to support the bottom surface of the elastic member 230, and prevent the elastic member 230 from detaching from the spacer body 220.

After the elastic member 230 is installed on the spacer body 220, the vertical portion 228 of the connector 226 formed on the upper plate 221 of the spacer body 220 is inserted into the connector receptacle 214 formed in the lower plate 212 of the spacer cover 210. Here, the horizontal portion 227 of the connector 226 is slidingly mounted over the top surface of the lower plate 212 of the spacer cover 210. The bottom portion of both ends of the spacer cover 210 are seated on the spacer cover seat 223 formed at the sides of the spacer body 220. Then, the inserting knob 232, having been inserted through the knob through-hole 224, is pressed on by the bottom surface of the lower plate 212 of the spacer cover 210. Thus, the inserting knob 232 descends a predetermined depth down through the knob through-hole 224. In this process, the restoring force of the flexible arm 234 connected to the inserting knob 232 accumulates.

The length of the vertical portion 228 is made to be longer than the thickness of the lower plate 212 of the spacer cover 210, so that there is a slight gap between the spacer cover 210 and the spacer body 220. The accumulated restoring force of the flexible arm 234 causes the inserting knob 232 to press against the lower plate 212 of the spacer cover 210. Thus, as shown in FIG. 4, the upper surface of the lower plate 212 of the spacer cover 210 and the lower surface of the horizontal portion 227 of the connector 226 are pressed together.

The above-structured panel spacer 200 is assembled with an appropriate number of spacer bodies 220 stacked at its lower portion, and is installed in the gap created by the door 140 and the front panel 110, so that the outward appearance of the door 140 is one of a single front panel 110 installed thereon. By using the panel spacer 200 structure according to the present invention, the same front panel can be installed on doors of different dimensions in order to reduce manufacturing costs.

The installation structure of the front panel of a dishwasher according to the present invention allows a panel spacer to be installed when the dimensions of a front panel are different from those of a door, so that the outward appearance is that of a single front panel installed.

In addition, even when the size of door is different for each product, by installing the panel spacer according to the present invention, the same front panel can be interchangeably used regardless of the door size to reduce manufacturing cost.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The panel spacer of a dishwasher according to the present invention and a dishwasher using the same improves the outward appearance of the dishwasher while reducing manufacturing costs, for a high industrial applicability.

The invention claimed is:

1. A dishwasher having a door and a control panel located a predetermined distance from the door, the dishwasher comprising:

a spacer cover installed between the door and the control panel;

at least one spacer body coupled to the spacer cover for filling a gap between the door and the control panel together with the spacer cover; and an elastic member coupled between the spacer cover and the spacer body and/or between two spacer bodies, the elastic member for pressing against the spacer cover and/or one of the two spacer bodies, wherein the spacer cover includes a flat upper plate and a lower plate spaced a predetermined distance below the upper plate, and at least one door hook, wherein the at least one door hook is formed at a rear of the spacer cover for coupling the spacer cover to the door, and wherein the spacer cover is coupled at the door, after the spacer body is coupled to the lower plate of the spacer cover, and wherein the upper plate defines an upper surface of the door.

2. The dishwasher according to claim 1, wherein the spacer body includes a through-hole formed in a top surface thereof for a portion of the elastic member to pass through.

3. The dishwasher according to claim 1, wherein the spacer body includes a retaining hook formed thereon for hooking the elastic member.

4. The dishwasher according to claim 3, wherein the retaining hook extends a predetermined distance downward and has a lower end thereof hooking inwards.

5. The dishwasher according to claim 1, wherein the elastic member includes:

a body;

a flexible arm extending from the body and having elasticity; and an inserting knob protruding a predetermined height from the flexible arm.

6. The dishwasher according to claim 5, wherein the flexible arm includes a periphery that is cut a predetermined distance from the body for imparting the elasticity to the flexible arm.

7. The dishwasher according to claim 1, wherein the spacer cover includes a connector receptacle formed in the lower plate thereof for coupling with the spacer body, and a hook formed at the rear of the upper plate thereof for coupling with the door.

8. The dishwasher according to claim 7, wherein the spacer body includes an upper plate and lower plate spaced below the upper plate, wherein the spacer body includes a connector receptacle formed in the lower plate thereof for coupling with another spacer body, and a connector protruding from the upper plate thereof for coupling with the connector receptacle of the spacer cover or the another spacer body.

9. The dishwasher according to claim 8, wherein the connector has a vertical portion passing through the connector receptacle and a horizontal portion extending from the vertical portion and catching on the connector receptacle.

10. The dishwasher according to claim 1, wherein the spacer body includes a spacer cover seat formed thereon for seating a lower portion of the spacer cover.

* * * * *